US005938475A

United States Patent [19]

Penner et al.

[11] Patent Number: 5,938,475

[45] Date of Patent: Aug. 17, 1999

[54] CONNECTOR FOR A CABLE HAVING AT LEAST ONE WIRE

[75] Inventors: Jürgen Penner, Mötzingen; Markus Cech, Stuttgart; Frank Andrä, Deizisau, all of Germany

[73] Assignee: Contact GmbH Elektrische Bauelemente, Stuttggart, Germany

[21] Appl. No.: 08/843,881

[22] Filed: Apr. 17, 1997

[30] Foreign Application Priority Data

Apr. 17, 1996 [DE] Germany ..... 196 15 158

[51] Int. Cl.[6] ..... H01R 9/03

[52] U.S. Cl. ..... 439/610; 439/98

[58] Field of Search ..... 439/92, 98, 99, 439/607, 610

[56] References Cited

U.S. PATENT DOCUMENTS 4,243,290 1/1981 Williams .

5,707,253 1/1998 Matdsumoto et al. ..... 439/610

FOREIGN PATENT DOCUMENTS

3026563 C2 5/1988 Germany .
3700514 A1 7/1988 Germany .
4107714 C1 7/1992 Germany .
4316903 A1 11/1994 Germany .

*Primary Examiner*—Khiem Nguyen
*Attorney, Agent, or Firm*—Haverstock & Owens LLP

[57] ABSTRACT

The invention relates to a connector for a cable having at least one wire and one screening which surrounds the wire, and also a housing in which an insulator with at least one electrical contact and a screening contact which contacts the housing are arranged, the screening contact producing an electrically conductive connection between the housing and the screening of the cable. The screening contact is resilient in the radial and/or axial direction and contacts the inside wall of the housing.

40 Claims, 8 Drawing Sheets

CONNECTOR FOR A CABLE HAVING AT LEAST ONE WIRE

BACKGROUND OF THE INVENTION

1. Field of the Invention

The invention relates to connectors for cables having at least one wire.

2. Description of the Prior Art

A large amount of data is transmitted and processed in production installations for controlling and monitoring production processes. The continual increase in automation of manufacturing and a reduction in supervisory staff requires accurate and uncorrupted data. Electromagnetic interference and the effects of interference from sources of interference, such as electric motors and switching operations, change and corrupt control signals in data lines interconnected by plug and socket connectors.

The invention relates to a connector for a cable of a type having at least:

one wire and one screening which surrounds the wire, the connector having a housing in which are arranged an insulator having at least one electrical contact, and a screening contact which contacts the housing and which produces an electrically conductive connection between the housing and the screening of the cable, wherein the screening contact is arranged to be resilient in a radial and/or axial direction and contacts the inside wall of the housing.

Connectors of this kind are known in the most diverse forms from the prior art (see, for example, U.S. Pat. No. 4,243,290 or DE 41 07 714 C1). However, these connectors have certain drawbacks. Firstly, the screening contact is usually formed by a cylindrical sleeve with a web portion surrounding it at a radial spacing therefrom and being pushed far enough under the screening braid of the cable for the front edge of the screening braid to rest against the web portion surrounding it. The housing which has previously been pushed onto the cable is then drawn up and the web portion which surrounds it at a radial spacing therefrom is pressed against the inside wall of the housing, so that an electrical contact is produced. In order to ensure that this contact has a sufficiently low contact resistance, it is necessary to make available sleeves with different diameters for the different diameter of the cables, which involves considerable expenditure in terms of manufacture and storage. Secondly, the overall operation of assembling the connector is relatively laborious and requires a high degree of manual dexterity. Finally, it is virtually impossible to assemble/take apart the connector a number of times whilst maintaining a constant contact quality for the housing, or without requiring that the cable is shortened so that the screening braid which has not yet been fanned out can be used for the contacting of the housing.

DE 37 00 514 A1 discloses a contact insert which can be inserted into a housing and which is used as a connection to earth. This contact insert is, admittedly, resiliently elastic in the radial direction. However, it serves the purpose of improving the connection to earth between the contact insert and the associated housing, and more simple replacement of the contact insert. The problem of dealing in as simple as possible a way with differences in diameter of cables on the one hand, and of the respective plug or socket connectors on the other hand, is not solved here.

DE 30 26 563 C2 discloses a spring collar with convex curvature for screening connectors which has spring fingers which are separated from each other by slits and which are screwed in screw-like manner, wherein the one longitudinal side is taller than the other. Therein, the slits are arranged alternatingly. However, one spring collar has to be manufactured for each individual diameter of cable or connector, which is very costly in terms of manufacture and storage.

DE 43 16 903 A1 discloses a contacting device for the metal braided sleeving of screened cables, by means of which contacting device the metal braided sleeving is able to be contacted in an electrically conductive manner with a connector housing. A contact member is formed by a helical spring which is pressed against the metal braided sleeving in its fitted condition and which encloses the metal braided sleeving annularly. To simplify the actual contacting and for the purpose of assembly it is provided that the helical spring is annular, encloses the metal braided sleeving of the screened cable, and consists of a sleeve-like clamping member which can be introduced into the metal braided sleeving of the screened cable and which can be latchingly engaged with the helical spring by pinching the metal braided sleeving.

DE 41 07 714 C1 discloses a coaxial connector, wherein the contacting between the cable outer conductor and a contact sleeve of the connector is effected by a contact spring, the central portion of which is held by means of an annular snap connection in such a way that it is parallel between the axes of two plastics portions. End portions which extend conically to the central axis of the contact spring or away therefrom have resilient tongue portions which are formed by slits and bear with pressure upon the cable outer conductor or contact sleeve.

Accordingly, an object of the present invention is to overcome the problems outlined hereinabove and to make available a connector which can be assembled easily and reliably with good contact making with a screening contact for cables of different diameters.

SUMMARY OF THE INVENTION

To meet this object, in accordance with a first feature of the invention, with the connector according to the invention, the screening contact is arranged such that the screening contact has a pressure member and a retaining member and the pressure member and the retaining member are in the form of interconnectable conical rings between which the screening is clampable in an electrically conductive manner, and wherein the retaining member and/or the pressure member has/have spring members which are resilient at least in the radial direction.

By virtue of this arrangement of the connector, for cables of different diameter—and with corresponding different diameters of their respective screenings—the screening contact can compensate for the differences in diameter, and produce a good electrical contact of constant quality between the screening and the inside wall of the housing.

The pressure member is thus in the form of a conical ring which presses the screening against the retaining member and fixes it there. This is obtained by way of a plurality of resilient latching members which are formed on the pressure member and are able to latch into corresponding recesses in the retaining member, so that a screening inserted between the pressure member and the retaining member has a secure electrical contact with the retaining member. The retaining member is likewise in the form of a conical ring, on the outer periphery of which a plurality of spherical spring members can be formed, so that a resilient elasticity is ensured in the radial direction and also partly in the axial direction (always in relation to the housing of the connector) to the inner periphery of the housing. The dimensions of the retaining member in relation to the pressure member are selected in such a way that the two members can be inserted into each other, and the screening is pressed against the retaining member when disposed between the two members.

In order to solve the aforementioned object, according to another aspect of the invention, the screening contact of the plug connector according to the invention is designed in a manner such that the screening contact has a substantially cylindrical sleeve having a side opening which extends over the entire length, wherein the opening into the inside of the sleeve has resilient side walls, the free ends of which are to be directed towards each other.

This permits very simple manufacture of the screening contact as a stamped part of sprung sheet metal with high electrical conductivity (preferably copper-beryllium). Furthermore, the maximum diameter of the cable (without outer insulation) is defined in practice only by the internal diameter of the cylindrical sleeve (less the thickness of the material of the side walls). At the same time, a plurality of contact locations of the side walls on the screening of the cable ensures reliable contacting.

According to a further developed variant of the above embodiment, the cylindrical sleeve forming the screening contact has spring members distributed along the outer periphery thereof which are elastic in the radial direction. This guarantees defined contacting with respect to the inner periphery of the housing and permits further compensation for varying diameters of the housing and cable.

In order to improve the handling of this embodiment of the connector, the external diameter of the cylindrical sleeve forming the screening contact is in proportion to the internal diameter of the housing such that an insulating sleeve can be inserted between the screening contact and the housing.

To establish the position of the insulating sleeve in relation to the cylindrical sleeve forming the screening contact, according to a preferred embodiment of the connector of the invention, the insulating sleeve has openings through its surface, through which openings the spring members of the screening contact are able to contact the inside wall of the housing.

Preferably, this insulating sleeve can be opened along its surface in order to accommodate the cylindrical sleeve forming the screening contact. As this opening (and closing) of the insulating sleeve does not happen very often, the insulating sleeve can have a film hinge and a latching device.

In order to improve the screening, particularly with cables of small diameter, the cylindrical sleeve forming the screening contact can have a screening plate at least at one of the end faces thereof, which screening plate has a recess. The cable is placed inside this recess (with the outer insulation removed) during assembly.

In order to establish the radial position of the cable in the cylindrical sleeve which forms the screening contact, the side walls of the screening contact which are resiliently sprung in the radial direction can have sections which are directed towards each other, with the free ends of the side walls directed away from each other.

According to another embodiment of the connector according to the invention, the screening contact has a spring wire which is substantially bent round and which has a hollow region along the periphery, wherein the hollow region is delimited by arms which are resiliently sprung in the radial direction to the periphery, the free ends of which are directed towards each other. This embodiment can be regarded as a simplified variant of the aforedescribed connector, wherein the cylindrical sleeve which forms the screening contact is replaced by a spring wire which is bent round.

As an alternative, according to further embodiments of the connector according to the invention, the screening contact can be in the form of a disk-like spring member which has alternating recesses and web portions which are directed towards the centre and which are resiliently deformable at least in the axial direction.

The screening contact can thus be in the form of a disk-like spring member which has alternating recesses and web portions which are bent at right angles at least sectionally in the axial direction and which are resiliently deformable at least in the radial direction.

In order to improve the contact making with respect to the inner periphery of the housing, the disk-like spring member can have at least one, preferably a plurality of, tongue-like spring member(s) along the periphery thereof, these spring members being resiliently elastic in the radial direction and able to contact the inside wall of the housing.

With a modified embodiment of this connector according to the invention, the web portions of the disk-like spring member have laterally spaced lamellar arms (possibly also curved concentrically towards the outer periphery) which assist radial and/or axial resilient springing of the web portions. This permits particularly good contacting of the screening of the cable, whilst providing a connector from a stamped component which is simple to manufacture for a relatively wide range of different cable diameters.

The aforedescribed embodiments of the connector according to the invention can also be sub-divided into the following two groups: firstly, those where the screening contact can be inserted into the housing from the side of the housing which faces the insulator, and secondly those where the screening contact can be inserted into the housing from the side of the housing which is remote from the insulator.

In particular, the disk-like embodiments and the embodiment of the screening contact which is bent from a spring wire are particularly suitable for assembly from the side of the housing which is remote from the insulator, whilst the sleeve-like embodiment of the screening contact is suitable for assembly from the side of the housing facing the insulator. However, by slight adaptation, it is also possible to fit the disk-like embodiments and the embodiment of the screening contact which is bent from spring wire "from the front", and respectively to fit the sleeve-like embodiment of the screening contact "from behind" (each respectively in relation to the housing of the connector).

To provide reliable and defined contact making with the inside wall of the housing by the disk-like screening contacts and screening contacts formed from spring wire, on the inside wall of the housing there is preferably an at least sectionally peripheral neck forming an inward collar.

In accordance with the invention, the screening contact can thus be pressed against the neck by means of a seal, wherein the seal and the screening contact arc pressed against the neck by means of a pressure screw which is applied to the cable.

BRIEF DESCRIPTION OF THE DRAWINGS

Further characteristics, features and advantages of the connector according to the invention are illustrated by the following description in which reference is made to the accompanying drawings, wherein.

DESCRIPTION OF THE PREFERRED EMBODIMENTS

Figure 1:
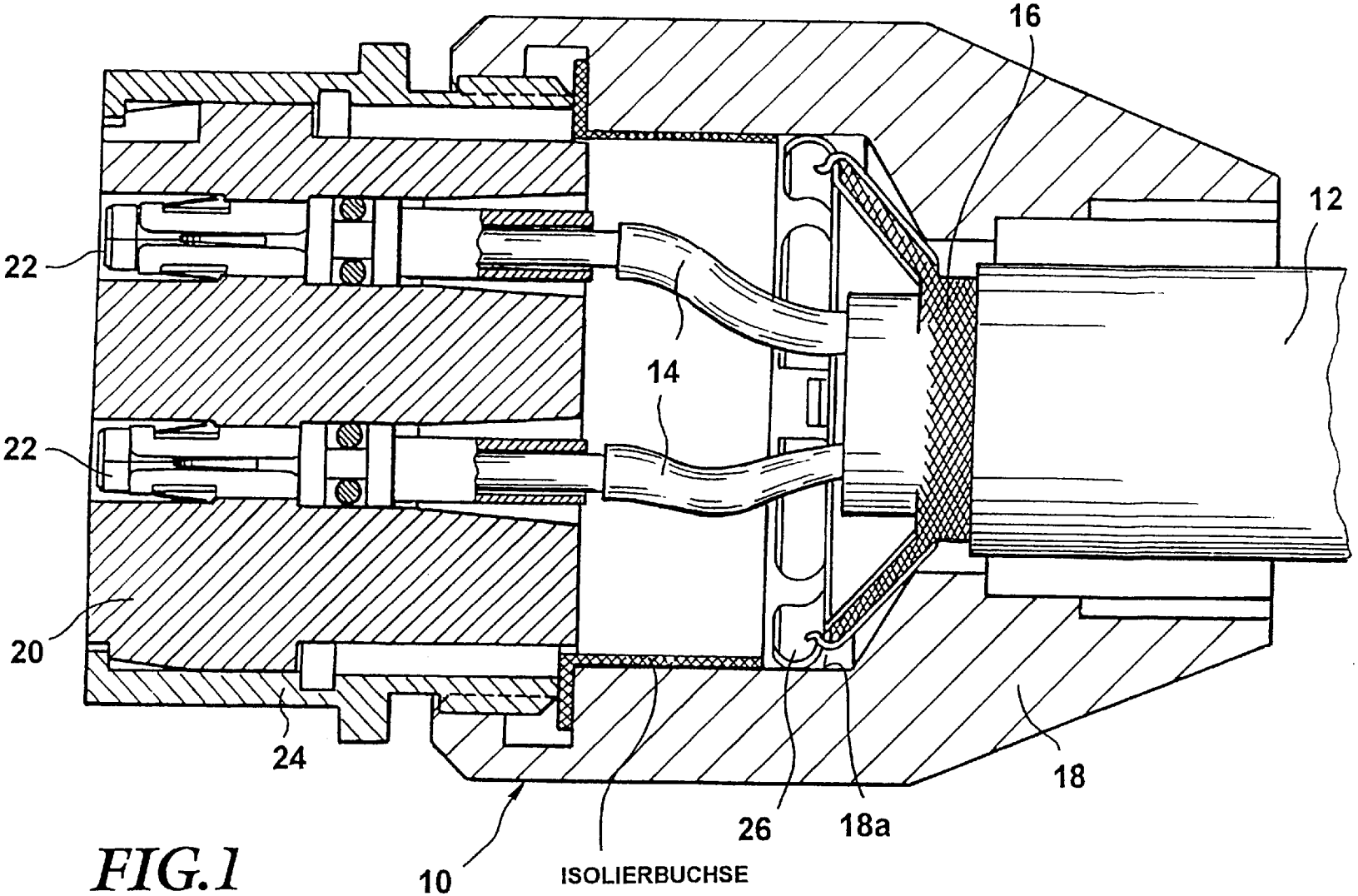
FIG. 1 is a schematic longitudinal section of a first embodiment of a connector according to the invention.
Figure 3A:
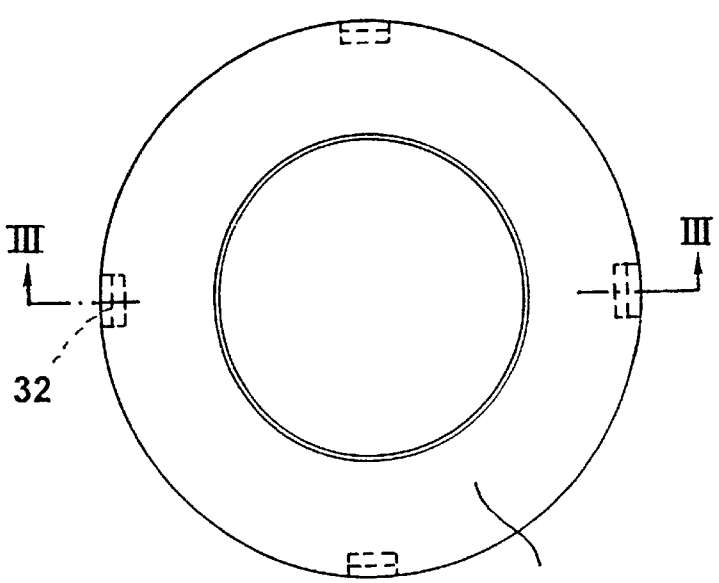
FIGS. 3*a* and 3*b* show a schematic view in plan of a pressure plate which forms part of the screening contact of the connector according to FIG. 1, and a schematic cross-section along the lines III—III, respectively.
Figure 3B:
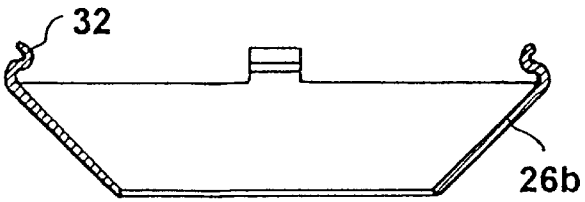
Figure 2A:
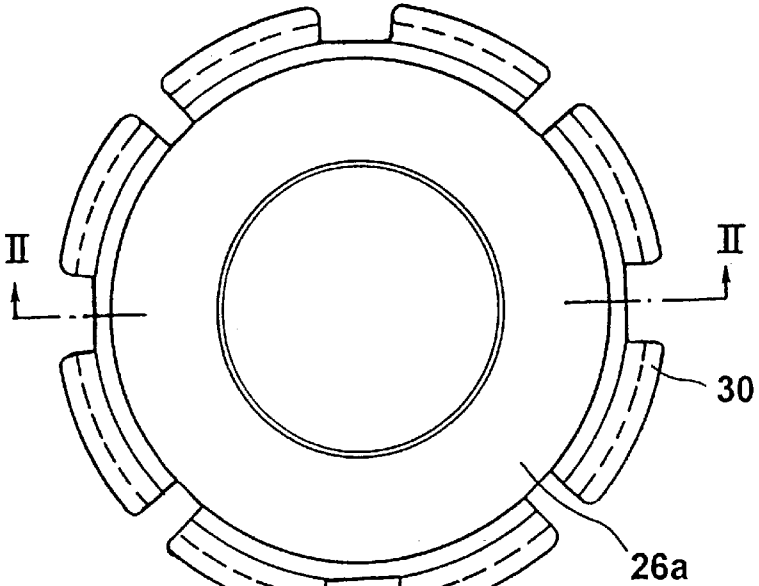
FIGS. 2*a* and 2*b* show a schematic view in plan of a retaining plate which forms part of the screening contact of the connector according to FIG. 1, and a schematic cross-section along the lines II—II, respectively.
Figure 2B:
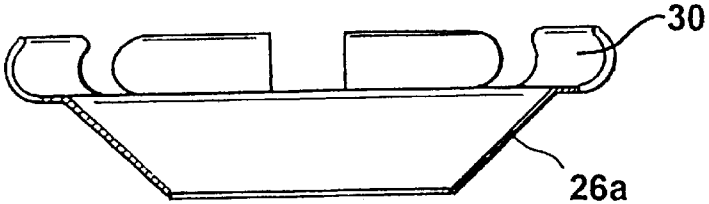

FIG. 1 shows a connector 10 for a cable 12 having a plurality of cores or wires 14 and a screening 16 in the form of a screening braid which encloses the wires 14. The connector has a housing 18 in which an insulator 20 is arranged with female electrical contacts 22. The insulator 20 is screwed to the housing 18 by a threaded sleeve 24 (which is preferably also metallic for reasons of mechanical strength and for screening). A screening contact 26 in the form of a screening member is arranged in the housing 18 and produces an electrically conductive connection between the housing 18 and the screening 16 of the cable 12. The screening contact 26 has a pressure member 26*a* and a retaining member 26*b* (see, in particular, FIGS. 2*a*, 2*b* and 3*a*, 3*b* respectively). With this embodiment, the screening contact is designed in two parts, wherein the pressure member 26*a* and the retaining member 26*b* are in the form of inter connectable conical rings between which the screening 16 of the cable 12 is clamped in an electrically conductive manner. Along its outer periphery the retaining member 26*a* has a plurality of (eight) bent spring members 30 of approximately semi-circular shape in cross-section by means of which the electrical contact is produced between the screening 16 and the housing 18 when the screening contact 26 has been assembled (see FIG. 1). The spring members 30 are formed integrally on the outer periphery of the retaining member 26*a* and are of a size such that the overall diameter of the retaining member 26*a* is slightly greater than the diameter of the inside wall 18*a* of the housing 18. Therefore, when the screening contact 26 is in the fitted condition, the spring members 30 are resiliently prestressed in the radial direction (in relation to the housing 18). The retaining member 26*b* has retaining hooks distributed uniformly along the outer periphery thereof, these hooks being so designed that each one engages between two spring members 30 of the pressure member 26*a*, detachably connecting the pressure member 26*a* to the retaining member 26*b*.

Figure 4C:
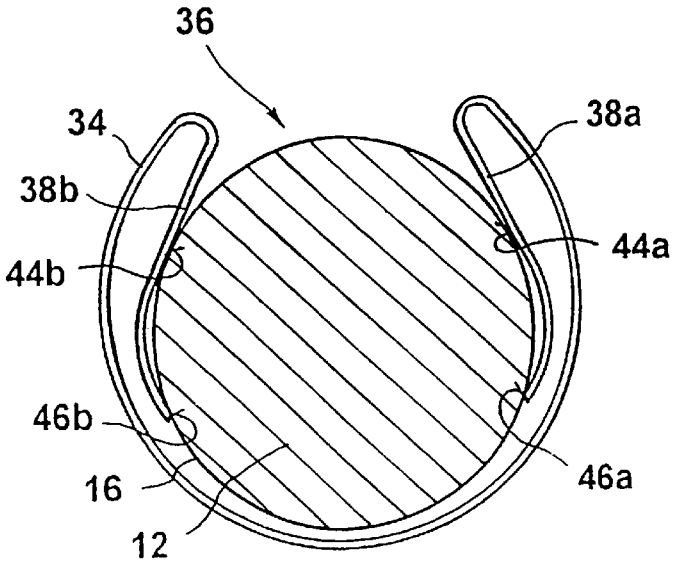
FIG. 4*c* shows the second embodiment of the screening contact according to FIG. 4*a* with a bared cable of greater diameter inserted therein.
Figure 4A:
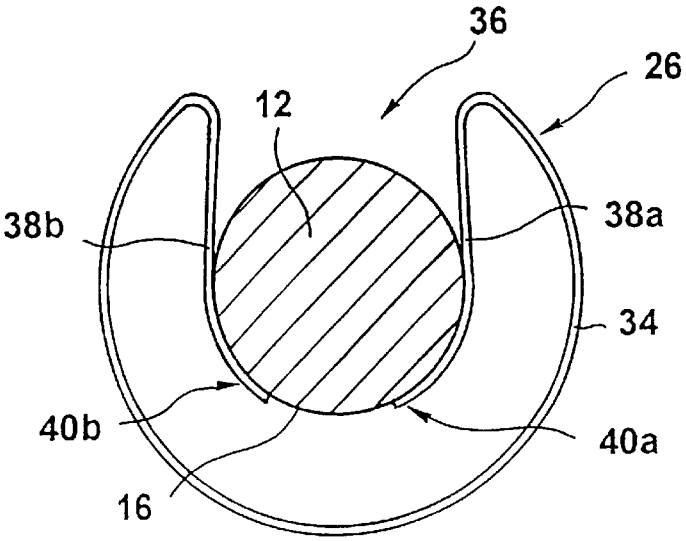
FIG. 4*a* is a schematic cross-section of a second embodiment of the screening contact of a connector according to the invention, with a bared cable of small diameter inserted therein.
Figure 4B:
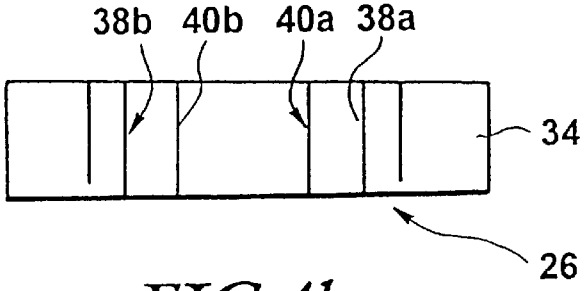
FIG. 4*b* shows a schematic view in plan of the screening contact according to FIG. 4*a;*

FIGS. 4*a* to 4*c* illustrate a further embodiment of a screening contact for a connector according to the invention. In these drawings, the screening contact 26 formed by a cylindrical sleeve 34 which has a side opening 36 extending over the entire length thereof. The opening has resiliently elastic side walls 38*a*, 38*b* directed into the inside of the sleeve, the free ends 40*a*, 40*b* of which are bent towards each other. Therein, the bending radius of the free ends 40*a*, 40*b* is selected such that a cable 12 (without external insulation) is introduced through the opening 36 and rests with slight prestressing of the side walls against the curved free ends 40*a*, 40*b* of the side walls 38*a*, 38*b*. This is the case for a cable 12 of relatively small diameter.

FIG. 4*c* shows the same cylindrical sleeve 34 for a cable 12 of greater diameter. Here, the side walls 38*a*, 38*b* are deformed to an extent that substantially linear contact locations 44*a*, 44*b*; 46*a*, 46*b* are formed between the side walls 38*a*, 38*b* and the screening 16 of the cable 12. To introduce the cable 12 into the opening 36 with the cylindrical sleeve 34 in the embodiment according to FIG. 4*c* (wherein the cable 12 has a greater diameter than with the embodiment according to FIG. 4*a*), the opening 36 or the two limbs of the cylindrical sleeve has/have to be bent apart far enough to allow the cable 12 to be introduced. Since the entire cylindrical sleeve is produced from sprung sheet metal as a stamped part, the cable 12 is firmly clamped by the side walls 38*a*, 38*b* after they are released.

Figure 6:
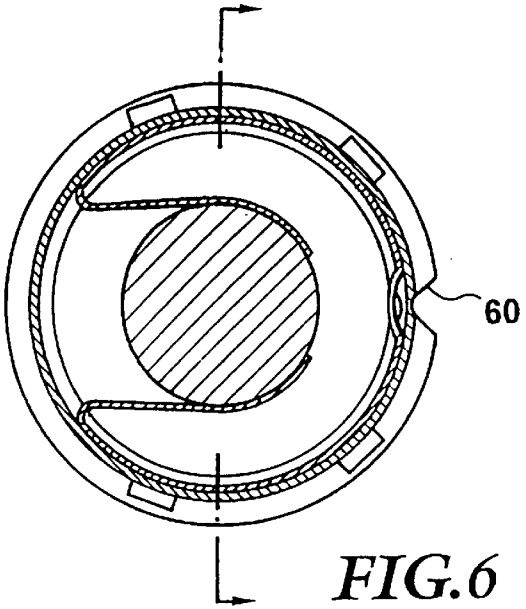
FIG. 6 shows a schematic cross-section of the second embodiment of the screening contact in an insulating sleeve, having a bared cable of small diameter inserted therein.
Figure 7:
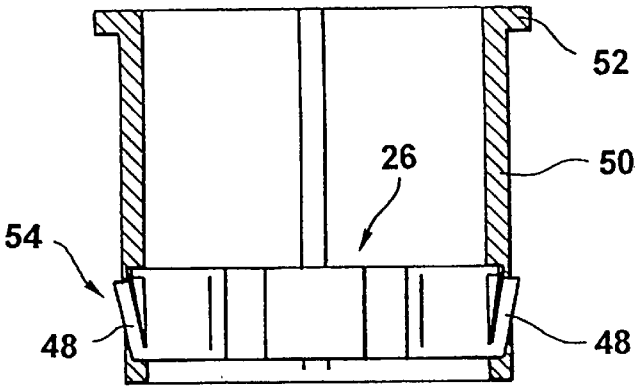
FIG. 7 shows a schematic cross-section along the line VI—VI of the screening contact in the insulating sleeve, without a bared cable inserted therein.

According to a different embodiment from that in FIGS. 4*a* to 4*c*, FIGS. 6, 7 and 8 show an improved screening contact 26, wherein the cylindrical sleeve 34 has a plurality of radially elastic spring members 48 distributed uniformly along the outer periphery thereof. The spring members 48 are in the form of tongue-like press-outs, which are resiliently sprung in the radial direction. As shown in FIG. 7, the cylindrical sleeve 34 can be arranged in an insulating sleeve 50 which can be equipped with a neck 52 in the form of a cylindrical tube. The insulating sleeve 50 projects beyond the screening contact 26 axially on both sides. Furthermore, the insulating sleeve 50 has a recess which extends along the internal diameter thereof, into which recess the cylindrical sleeve 34 can be fitted. The recess is provided with openings through which the tongue-like spring members 48 are able to project outwardly and thus contact the inside wall 18*a* of the housing 18. The external diameter of the cylindrical sleeve 34 is arranged with respect to the internal diameter of the housing 18 such that the insulating sleeve 50 can be inserted between the cylindrical sleeve 34 forming the screening contact 26 and the housing 18. The outer periphery of the insulating sleeve 50 is provided with an indentation forming a film hinge 60, so that the insulating sleeve 50 can be laterally folded on. In order that the insulating sleeve 50 firmly encloses the cylindrical sleeve 34, the insulating sleeve 50 has a retaining hook 62 at the edge of one half-shell portion, which retaining hook is able to engage into a corresponding recess 64 in the other half-shell portion.

Figure 10B:
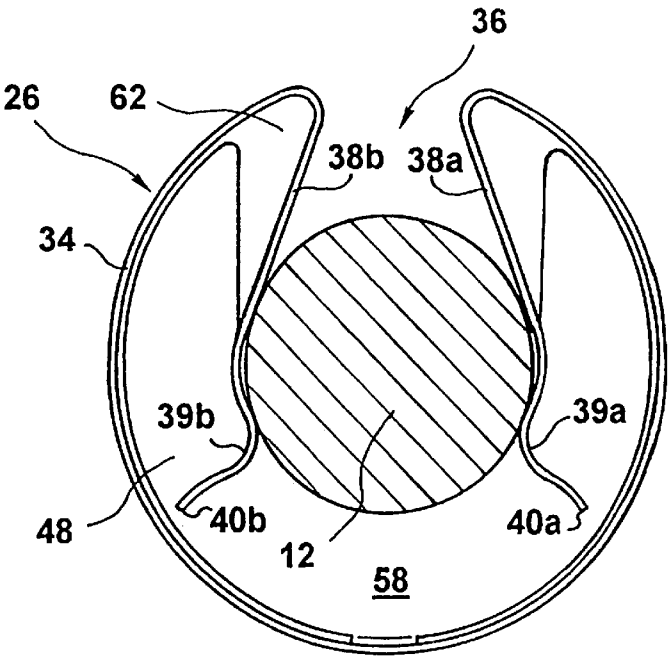
FIG. 10*b* shows a schematic view in plan of the screening contact according to FIG. 10*a;*
Figure 10A:
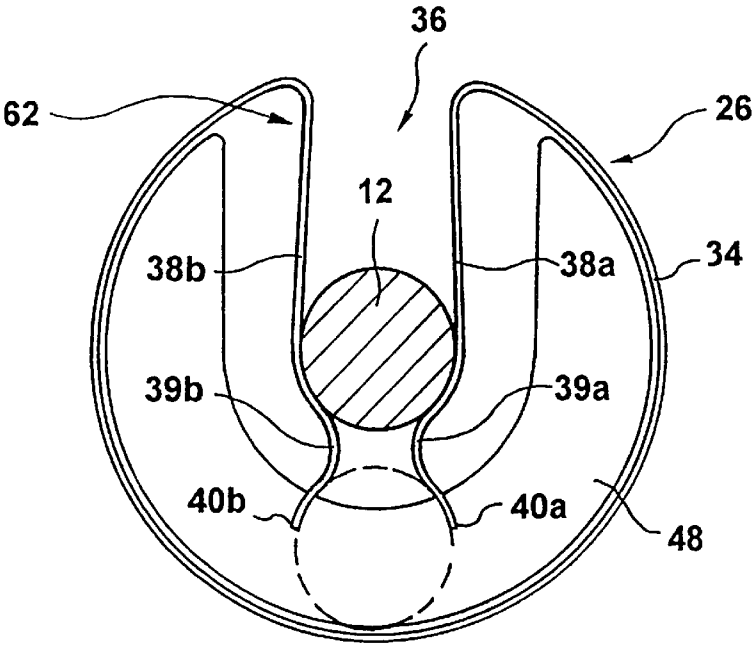
FIG. 10*a* shows a schematic cross-section of a fourth embodiment of the screening contact of a connector according to the invention, having a bared cable of small diameter inserted therein.
Figure 10C:
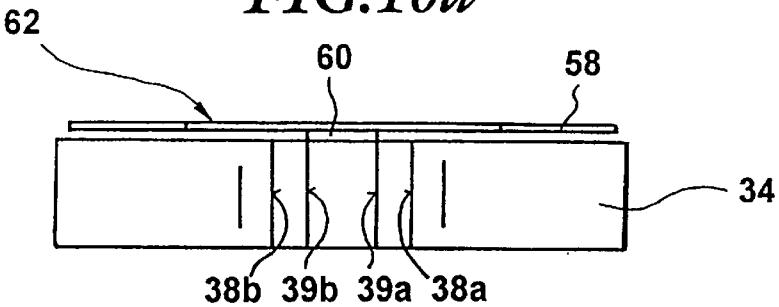
FIG. 10*c* shows the fourth embodiment of the screening contact according to FIG. 10*a*, with a bared cable of greater diameter inserted therein.

FIG. 10*a*, 10*b*, 10*c* illustrate another embodiment of screening contact for a connector according to the invention. In these drawings, the screening contact 26 is formed by a cylindrical sleeve 34 which has a lateral opening 36 extending along the entire length thereof. The opening has resiliently elastic side walls 38*a*, 38*b* which are directed into the inside of the sleeve and which have sections 39*a*, 39*b* of convex curvature towards each other, the free ends 40*a*, 40*b* of which are bent away from each other. Thus, the bending radius of the sections 39*a*, 39*b* which are bent towards each other and the free ends 40*a*, 40*b* is selected in such a way that a cable 12 (without outer insulation) can be introduced through the opening and rest both between the sections 39*a*, 39*b* which are curved towards each other and between the curved free ends 40*a*, 40*b* of the side walls 38*a*, 38*b* with slight prestressing of the side walls. This is the case with a cable 12 of relatively small diameter (see FIG. 10*a*). A U-shaped face plate 58 is formed integrally on an end face of the cylindrical sleeve 34 by a web portion 60. The outer contours of the face plate 58 are adapted to the shape of the cylindrical sleeve 34. In addition, the face plate 58 has a recess 62 which is of a size such that a cable of greater diameter can also be introduced therein (see FIG. 10*b*).

FIG. 10*b* shows the same cylindrical sleeve 34 for a cable 12 of greater diameter. Here, the side walls 38*a*, 38*b* are deformed to such an extent that substantially linear contact locations 44*a*, 44*b*; 46*a*, 46*b* are formed between the side walls 38*a*, 38*b* and the screening 16 of the cable 12. To introduce the cable 12 into the opening 36 with the cylindrical sleeve 34 in the embodiment according to FIG. 10*b* (wherein the cable 12 is greater in diameter than with the embodiment according to FIG. 10*a*) the opening 36 or the two limbs of the cylindrical sleeve is/are bent apart far enough to enable the cable 12 to be introduced. Since the cylindrical sleeve as a whole is produced as a stamped sprung sheet metal part, the cable 12 is clamped firmly by the side walls 38*a*, 38*b* after release.

Figure 8:
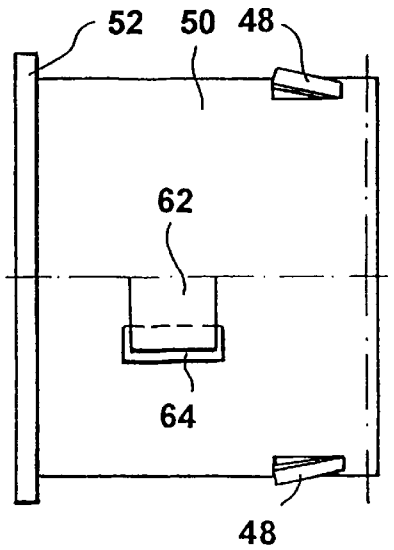
FIG. 8 shows a schematic side view of the insulating sleeve according to FIG. 6, with a screening contact inserted therein.

The spring tongues 48 shown in FIGS. 6 to 8 can also be provided in this embodiment.

Figure 9:
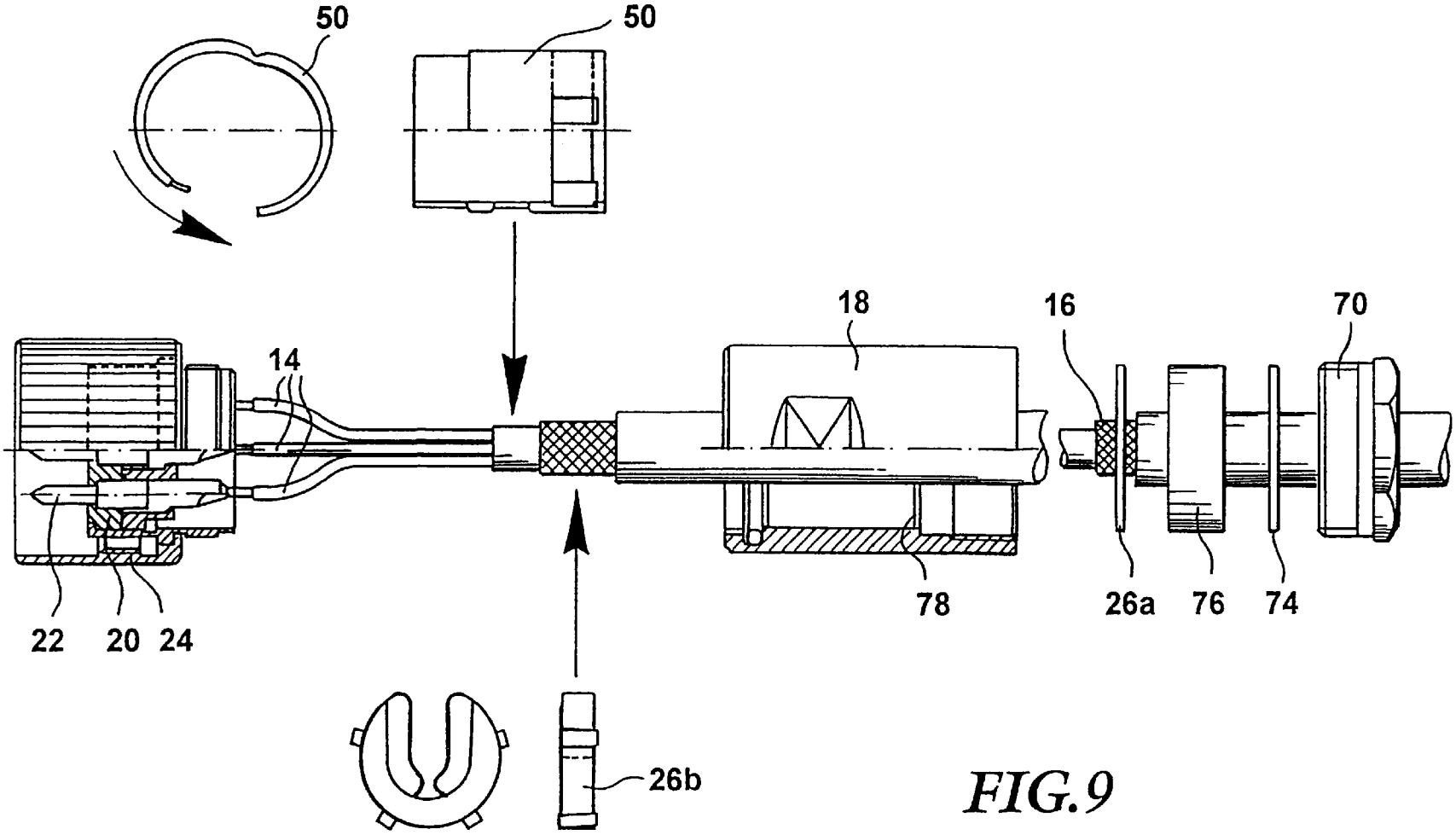
FIG. 9 is a schematic, exploded view of the connector according to the invention with the capacity for being assembled with different embodiments of screening contact.

FIG. 9 is an assembly drawing with various assembly possibilities for the connector according to the invention.

First of all, a clamping screw 70 (armoured conduit thread or metric thread) is pushed over the bared cable 12 which has been cut to length. Following the clamping screw 70 there is a seal consisting of 2 sealing members 74, 76. Finally, a first screening contact 26*a* is pushed over the cable 12. The cable 12 is manufactured in such a way that the wires 14 project through the housing 18 and can be soldered, crimped, or otherwise connected to the contacts 22 in the insulator 20. The screening contact 26*a* then comes to rest inside the housing 18 on a neck 78, and thereby produces the electrical contact between the screening 16 of the cable 12 and the (metal) housing 12.

Alternatively (or additionally) it is possible (see bottom left of FIG. 9) for the screening contact 26*b* to be guided from the side over the cable 12 which has been pushed through the housing 18. The insulating sleeve 50 is then folded over the screening contact and latched in place. The housing 18 is then screwed to the threaded sleeve 24, so that the insulator 50 together with the screening contact 26*b* is disposed therebetween. The spring tongues 48 of the screening contact 26*b* which project through the insulator 50 thus produce the electrical contact between the screening 16 of the cable 12 and the (metal) housing 12. Finally, the pressure screw 70 closes the housing 18 to the rear with the interposition of the sealing members 74, 76.

This means that the screening contact 26*b* is able to be introduced into the housing 18 from the side of the housing 18 facing the insulator 20, whilst the screening contact 26*a* is able to be introduced into the housing 18 from the side of the housing 18 remote from the insulator 20.

Figure 5B:
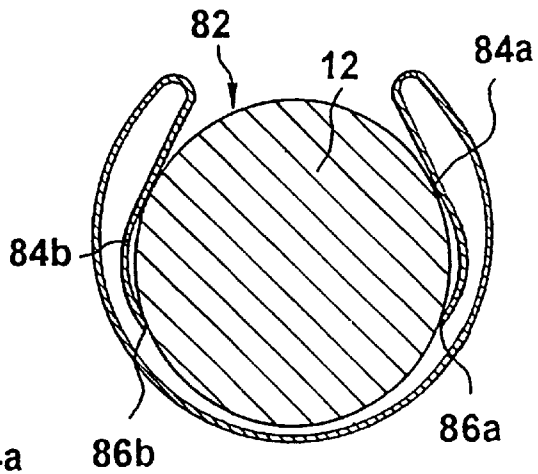
FIG. 5*b* shows a schematic cross-section of the third embodiment of the screening contact according to FIG. 5*a*, having a bared cable of greater diameter inserted therein.
Figure 5A:
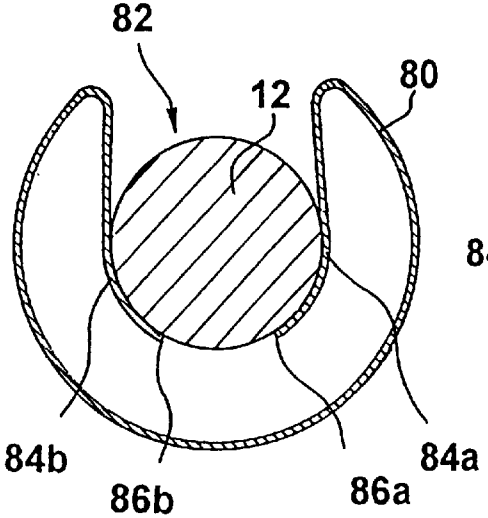
FIG. 5*a* shows a schematic cross-section of a third embodiment of the screening contact of a connector according to the invention, having a bared cable of small diameter inserted therein.

With the embodiment shown in FIGS. 5*a*, 5*b* of a screening contact 26 for a connector according to the invention, the screening contact 26 is formed of a spring wire 80 which is substantially bent round and which has a hollow region 82 along the periphery thereof, wherein the hollow region 82 is defined by arms 84*a*, 84*b* which are resiliently elastic in a radial direction towards the periphery, the free ends 86*a*, 86*b* of which arms have to be bent towards each other over approximately one quarter of the circumference. Therein, the bending radius of the free ends 86*a*, 86*b* is selected in such a way that a cable 12 (without outer insulation) is introduced through the opening 82 and rests against the curved free ends 86*a*, 86*b* of the side walls 84*a*, 84*b* with slight prestressing of the side walls. This is the case with a cable 12 of relatively small diameter (see FIG. 5*a*).

To introduce the cable 12 into the opening 82 with the embodiment according to FIG. 5*b*, wherein the cable 12 is of greater diameter than with the embodiment according to FIG. 5*a*, the opening 82 or the two limbs of the spring wire has/have to be bent apart far enough to allow the cable 12 to be introduced. Since the screening contact 26 is manufactured from a spring wire, the cable 12 is firmly clamped by the side walls 84*a*, 84*b* after release.

Figure 13:
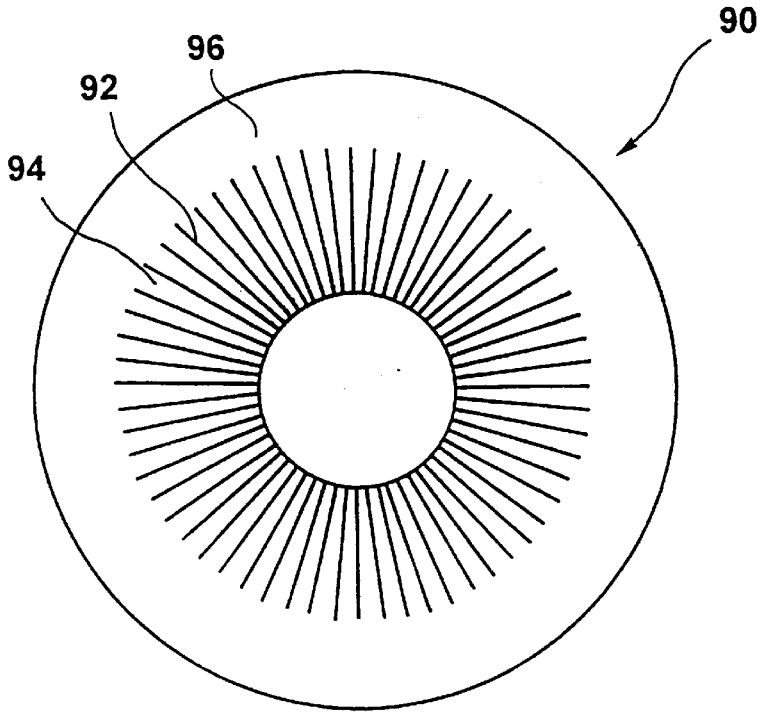
FIG. 13 shows a schematic side view of a seventh embodiment of the screening contact of a connector according to the invention.

With the embodiments of the screening contact 26 according to FIGS. 11, 13, this latter is in the form of a disk-like spring member 90 which has alternating recesses 92 and web portions 94 which are formed around a circular ring 96 and which are directed towards the centre thereof. The web portions 94 are resiliently deformable in the axial direction and are of a length such that they leave a space in the centre of the screening contact 26 for a cable 12.

Figure 11A:
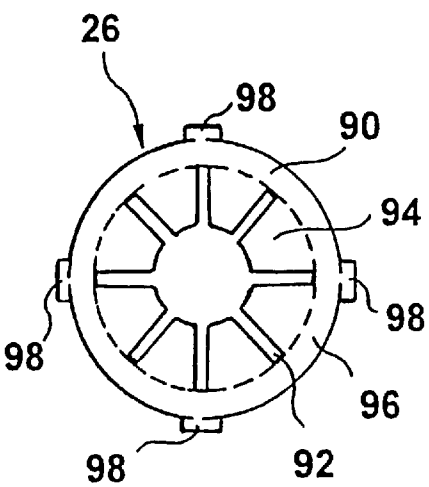
FIG. 11*a* shows a schematic plan view of a fifth embodiment of the screening contact of a connector according to the invention.
Figure 11B:
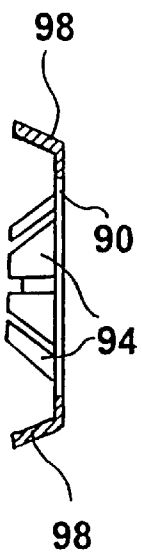
FIG. 11*b* shows a schematic side view of the fifth embodiment of the screening contact according to FIG. 11*a;*

As shown in FIG. 11*b*, the web portions 94 can be bent at right angles sectionally in the axial direction, so that they are resiliently deformable, at least in the radial direction (with respect to the axis of the housing). The spring member 90 has four tongue-like spring members 98 distributed uniformly over the periphery thereof, these spring members being resiliently elastic in the radial direction and of a size such that they are able to contact the inside wall 18*a* of the housing 18.

Figure 12:
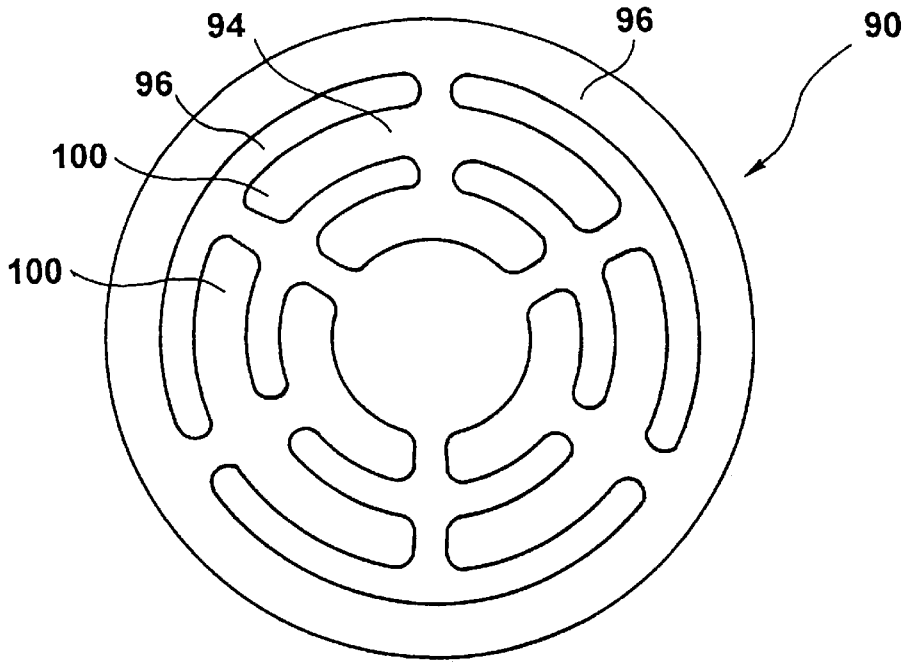
FIG. 12 shows a schematic side view of a sixth embodiment of the screening contact of a connector according to the invention.

With the embodiment of a spring member 90 shown in FIG. 12, the web portions 94 of the disk-like spring member 90 have laterally spaced apart lamellar arms 100 which promote radial and/or axial resilient elasticity of the web portions 94 to improve contact making at the cable 12.

Spring members 98, such as those shown in FIGS. 11*a* and 11*b*, can also be provided in the embodiments according to FIGS. 12 and 13.

The embodiments of a plug and/or socket connector according to the invention and the screening contact thereof offer reliable screening for cables with respect to EMF effects and the possibility for great variation in the diameter of the cable with the same connector. The aforedescribed insulating sleeve, independently of the advantages of the embodiments of the screening contacts, has the advantage of a defined position in the housing for the screening contact as well as simplified operation. The screening contacts can be manufactured as inexpensive and simple stamped and/or bent sheet metal parts. The screening is independent of the screwing on means of armoured conduit threaded screw. Assembly can be carried out in a logical sequence (as the individual components are threaded onto the cable).

Although particular embodiments of the invention have been described, it will be appreciated that these are by way of illustration only and are not to be interpreted in a limiting manner. It will be appreciated that many modifications, additions and alternatives to the described embodiments may be made within the spirit and scope of the invention as defined in the claims.

What is claimed is:

1. A connector for a cable having at least one wire and one screening which surrounds the wire, the connector having a housing comprising:

a. an insulator having at least one electrical contact connectable to the wire of the cable; and b. a screening contact which contacts the housing and which provides an electrically conductive connection between the housing and the screening of the cable, wherein the screening contact is elastically deflectable against a resilient bias in a radial and/or an axial direction and contacts an inside wall of the housing; and, further wherein, the screening contact has a substantially cylindrical sleeve having a side opening which extends over the entire length of the sleeve, wherein the opening into the inside of the sleeve has resilient side walls that are elastically deflectable against a resilient bias, the free ends of which are to be directed towards each other to provide a constricted portion of the opening for retaining the cable.

2. The connector according to claim 1 wherein the screening contact is selectively insertable into the housing from a side of the housing facing the insulator.

3. The connector according to claim 1 wherein the screening contact is selectively insertable into the housing from a side of the housing remote from the insulator.

4. The connector according to claim 1 wherein the cylindrical sleeve which forms the screening contact has spring members distributed along its outer periphery which are resilient in the radial direction.

5. The connector according to claim 4 wherein an external diameter of the cylindrical sleeve which forms the screening contact is arranged with respect to an internal diameter of the housing such that an insulating sleeve is insertable between the screening contact and the housing.

6. The connector according to claim 5 wherein the insulating sleeve has openings which pass through its surface, through which openings the spring members of the screening contact make contact with the inside wall of the housing.

7. The connector according to claim 6 wherein the insulating sleeve includes means for selectively opening the insulating sleeve along its surface.

8. The connector according to claim 1 wherein the cylindrical sleeve which forms the screening contact has a screening plate on at least one of its end faces, which screening plate has a recess.

9. The connector according to claim 8 wherein side walls of the screening contact which are resilient in the radial direction have sections which are directed toward each other, and wherein free ends of the side walls are directed away from each other.

10. The connector according to claim 1, wherein the connector is a plug connector.

11. The connector according to claim 1, wherein the connector is a socket connector.

12. A connector for a cable, the connector comprising:

a housing within which are provided:

an insulator having at least one electrical contact connectable to a wire of the cable, and a screening contact which contacts the housing and which provides an electrically conductive connection between the housing and a screening which surrounds the wire of the cable;

wherein the screening contact is elastically deflectable against a resilient bias in a radial direction and contacts an inside wall of the housing, and comprises a substantially cylindrical sleeve having a side opening which extends over an entire length of the sleeve, wherein the opening into an inside of the sleeve has resilient side walls that are elastically deflectable against a resilient bias, at least portions of free ends of side walls being directed towards one another to provide a constricted portion of the opening for retaining the cable.

13. The connector according to claim 12 wherein the cylindrical sleeve which forms the screening contact has spring members distributed along an outer periphery thereof, the spring members being elastically deflectable in the radial direction.

14. The connector according to claim 12, wherein side walls of the screening contact have sections which are directed towards one another, the free ends of the side walls being directed away from one another.

15. The connector according to claim 14 wherein the cylindrical sleeve which forms the screening contact has spring members distributed along the outer periphery thereof, the spring members being elastically deflectable in the radial direction.

16. The connector according to claim 12, wherein the free ends of the sidewalls are directed towards one another.

17. The connector according to claim 16 wherein the cylindrical sleeve which forms the screening contact has spring members distributed along the outer periphery thereof, the spring members being elastically deflectable in the radial direction.

18. The connector according to claim 17 wherein the insulating sleeve has openings which pass through the surface thereof, through which openings the spring members of the screening contact are able to contact the inside wall of the housing.

19. The connector according to claim 12 wherein the external diameter of the cylindrical sleeve which forms the screening contact is smaller than the internal diameter of the housing to provide a gap between the contact and the housing within which an insulating sleeve may be inserted.

20. The connector according to claim 19 wherein the insulating sleeve comprises two portions joined at one edge thereby allowing the sleeve to be opened along its surface.

21. The connector according to claim 19 wherein the insulating sleeve has openings which pass through the surface thereof, through which openings the spring members of the screening contact are able to contact the inside wall of the housing.

22. The connector according to claim 21 wherein the insulating sleeve comprises two portions joined at one edge thereby allowing the sleeve to be opened along its surface.

23. The connector according to claim 12 wherein the cylindrical sleeve which forms the screening contact has a screening plate on at least one of the end faces thereof, which face plate has a recess.

24. The connector according to claim 12 wherein the screening contact can be introduced into the housing from a same side of the housing as the insulator.

25. The connector according to claim 12 wherein the screening contact can be introduced into the housing from an opposite side of the housing to that from which the insulator can be introduced.

26. The connector according to claim 12 wherein the connector is a plug connector.

27. The connector according to claim 12 wherein the connector is a socket connector.

28. A connector for a cable, the connector comprising:

a housing within which are provided:

an insulator having at least one electrical contact connectable to a wire of the cable, and a screening contact which contacts the housing and which provides an electrically conductive connection between the housing and a screening which surrounds the wire of the cable;

wherein the screening contact is elastically deflectable against a resilient bias in a axial direction and contacts an inside wall of the housing, and comprises a substantially cylindrical sleeve having a side opening which extends over an entire length of the sleeve, wherein the opening into an inside of the sleeve has resilient side walls that are elastically deflectable against a resilient bias, at least portions of free ends of side walls being directed towards one another to provide a constricted portion of the opening for retaining the cable.

29. The connector according to claim 28 wherein side walls of the screening contact have sections which are directed towards one another, the free ends of the side walls being directed away from one another.

30. The connector according to claim 28 wherein the free ends of the sidewalls are directed towards one another.

31. The connector according to claim 28 wherein the insulating sleeve has openings which pass through the surface thereof, through which openings the spring members of the screening contact are able to contact the inside wall of the housing.

32. The connector according to claim 28 wherein the external diameter of the cylindrical sleeve which forms the screening contact is smaller than the internal diameter of the housing to provide a gap between the contact and the housing within which an insulating sleeve may be inserted.

33. The connector according to claim 32 wherein the insulating sleeve comprises two portions joined at one edge thereby allowing the sleeve to be opened along its surface.

34. The connector according to claim 32 wherein the insulating sleeve has openings which pass through the surface thereof, through which openings the spring members of the screening contact are able to contact the inside wall of the housing.

35. The connector according to claim 34 wherein the insulating sleeve comprises two portions joined at one edge thereby allowing the sleeve to be opened along its surface.

36. The connector according to claim 28 wherein the cylindrical sleeve which forms the screening contact has a screening plate on at least one of the end faces thereof, which face plate has a recess.

37. The connector according to claim 28 wherein the screening contact can be introduced into the housing from a same side of the housing as the insulator.

38. The connector according to claim 28 wherein the screening contact can be introduced into the housing from an opposite side of the housing to that from which the insulator can be introduced.

39. The connector according to claim 28 wherein the connector is a plug connector.

40. The connector according to claim 28 wherein the connector is a socket connector.

* * * * *